United States Patent [19]

Hilaire et al.

[11] 4,101,407

[45] Jul. 18, 1978

[54] HORIZONTAL ELECTROLYZERS WITH MERCURY CATHODE

[75] Inventors: Pierre Hilaire, Grenoble; Georges Lonchampt, Meylan, both of France

[73] Assignee: Commissariat a l'Energie Atomique, Paris, France

[21] Appl. No.: 763,614

[22] Filed: Jan. 28, 1977

[30] Foreign Application Priority Data

Jan. 30, 1976 [FR] France ..... 76 03015

[51] Int. Cl.[2] ..... C25B 1/46; C25B 1/40

[52] U.S. Cl. ..... 204/251; 204/220

[58] Field of Search ..... 204/250, 251, 99, 219–220

[56] References Cited

U.S. PATENT DOCUMENTS 646,313 3/1900 Rhodin ..... 204/251 X 4,002,550 1/1977 Smirhov et al. ..... 204/251 X

FOREIGN PATENT DOCUMENTS 701,771 1/1941 Fed. Rep. of Germany ..... 204/251

650,779 3/1951 United Kingdom ..... 204/219

*Primary Examiner*—John H. Mack

*Assistant Examiner*—D. R. Valentine

*Attorney, Agent, or Firm*—Ostrolenk, Faber, Gerb & Soffen

[57] ABSTRACT

A horizontal electrolyzer comprises a mercury cathode, an anode located above the cathode and an inclined diaphragm separating the cathode from the anode, the cathode, diaphragm and anode being substantially parallel. The cathode consists of mercury flowing longitudinally in a plurality of channels which are vertically offset with respect to each other.

15 Claims, 3 Drawing Figures

$\eta_F$ (%)
100
A
E
I
II
B
$\eta_F(\delta)$
D
C
100
0
$\delta$ (%)

HORIZONTAL ELECTROLYZERS WITH MERCURY CATHODE

The invention relates to electrolyzers having a mercury cathode and of the type which is currently qualified as "horizontal." The cathode of such an electrolyzer consists of mercury flowing on a sloped conductive surface and separated from anode means by a diaphragm. Such electrolyzers are currently used for the preparation of chemicals, in particular for the production of chlorine and caustic soda by electrolysis of an alkali metal chloride.

The lower part of these electrolyzers comprises a layer of mercury connected to a negative voltage. Above the layer of mercury which constitutes the cathode are arranged anodes made of materials which are compatible both with the compounds to be treated and with the product produced from them by electrolysis. Lastly, a diaphragm which is permeable to ions and therefore also to the electric current is arranged between the anodes and the cathode to prevent mixing of the anolyte and catholyte.

For optimum operation of these electrolyzers, substantially the whole surface of the diaphragm must be wetted with the liquid electrolytes and the distance between the anode means and the cathode means must be constant. In the course of operation, the gases produced at the cathode collect under the diaphragm before they are evacuated from the electrolyzer through suitable conduits.

In a prior art electrolyzer of that type (French patent specification No. 1,000,268), reliance is had on the slope of the diaphragm to direct the gas which appear at the cathode toward evacuating means. For that purpose, the slope of diaphragm should be relatively high (2% for instance). On the other hand, the surface of the mercury cathode is approximately parallel to the diaphragm. With such a high slope, the mercury flows at a relatively high speed, much higher than that of the cathodic solution or catholyte. There is consequently eddies in the catholyte and a mixing which is detrimental to yield.

In another prior art arrangement (German patent specification No. 701,771), there is provided an electrolyzer whose anode is separated by a diaphragm from a cathode consisting of mercury which circulates by overflow through a plurality of steps, the steps being located along a slope which is parallel to the diaphragm and to the anode. Overflow results in eddies in the catholyte and the amount of mercury which spills over from each step changes along each step (particularly if the steps are of large length) except if a large amount of overspill is used which then results in the need for a large inventory of mercury.

It is an object of the invention to provide an improved horizontal electrolyzer in which eddies are minimized in the catholyte.

It is another object of the invention to provide an electrolyser in which the flow of mercury may be relatively slow, while collection and evacuation of gas developped under the diaphragm remains satisfactory.

According to an aspect of the invention, there is provided an horizontal electrolyzer comprising:

a housing; diaphragm means inclined in the direction transverse to the direction of flow of the mercury and separating said housing into a lower cathode compartment and an upper anode compartment; a plurality of parallel channels located in said cathode compartment and inclined at a slight longitudinal angle to the horizontal, said channels being vertically staggered with respect to each other for their midlines to be in a plane approximately parallel to the diaphragm means; means for delivering mercury to the upper end of said channels and collecting mercury at the lower end thereof, and anode means in said anode compartment.

Due to this arrangement, the diaphragm may have a transversal slope which is sufficient for preventing trapping of gas pockets under the diaphragm while the slope of the channel may have the lowest value compatible with a steady flow (1% to 1.5% for example). The speed of the mercury is then low and does not result in substantial mixing of the various parts of the catholyte which circulates along the same direction as the mercury at a speed which is generally of from 1 to some centimeters per second.

For further decreasing mixing, it is of advantage to use an electrolyzer whose ratio between the length and the width is at least 10. The electrolytes then flow along the cathodic and anodic compartments "en bloc" with a substantially constant velocity throughout the stream. If, for example, the electrolyzer is used for an oxidation-reduction reaction, it is known that the Faraday yield decreases when the percentage of chemically reduced compound increases. Assuming that there is complete remixing of the catholyte, then the overall Faraday yield is substantially equal to the yield corresponding to the percentage of reduced compound at the output of the electrolyzer. On the other hand, if the flow occurs "en bloc," there is satisfactory yield on the greater portion of the length of the electrolyzer.

The diaphragm may be located in a single inclined plane or may be in the form of one or more dihedrals. The diaphragm may be of a material which is slightly permeable to liquid, such as the porous ceramics currently used in the electrolyzers for the production of chlorine. Then, to minimize the amount of mixing between anolyte and catholyte, it is advisable to use means for supplying and removing electrolyte which maintains pressure balance across the diaphragm. The diaphram may also be not permeable to liquid, but permeable to ions. An ion exchange resin will then be used.

For pressure balance, the means for evacuation of the electrolyte may consist of overflow pipes, some placed in the anode compartment for removal of the anolyte and others located in an enclosure limited by walls whose lower portion is formed with openings permitting inflow of catholyte.

The height of these overflow pipes may be adjustable for controlling the level of electrolytes and hence the equilibrium of pressures in the two compartments.

Pressure balance may be obtained by placing one set of overflow pipes, for example those for the anolyte, at a predetermined height and adjusting the position of the set of overflow pipes for the catholyte. In this case, the adjustment required is determined by measuring the flow rate of anolyte.

The height of the overflow pipes for the anolyte may as well be adjusted after having fixed the position of the overflow pipes for the catholyte.

For less accurate adjustment of the electrolyzer (if it is sufficient that one electrolyte is free from the other), the height of the overflow pipes can simply be adjusted for maintaining a slight excess pressure in one compartment. If, for example, it is desired to keep a catholyte free from anolyte, it is sufficient to place the overflow pipes of the cathode compartment at a sligthly higher level than that theoretically required for obtaining equal pressure in the two compartments. A slight excess pressure is thus created which permits a small flow of catholyte to enter the anode compartment but prevents anolyte from migrating to the catholyte. The opposite effect is achieved by placing the overflow pipes of the catholyte below the said theoretical level, in which case some anolyte will enter the cathode compartment.

The invention will be better understood from a consideration of the following description of embodiments of the invention, given by way of examples. The description refers to the accompanying drawings.

SHORT DESCRIPTION OF THE DRAWINGS

In the drawings

Figure 1:
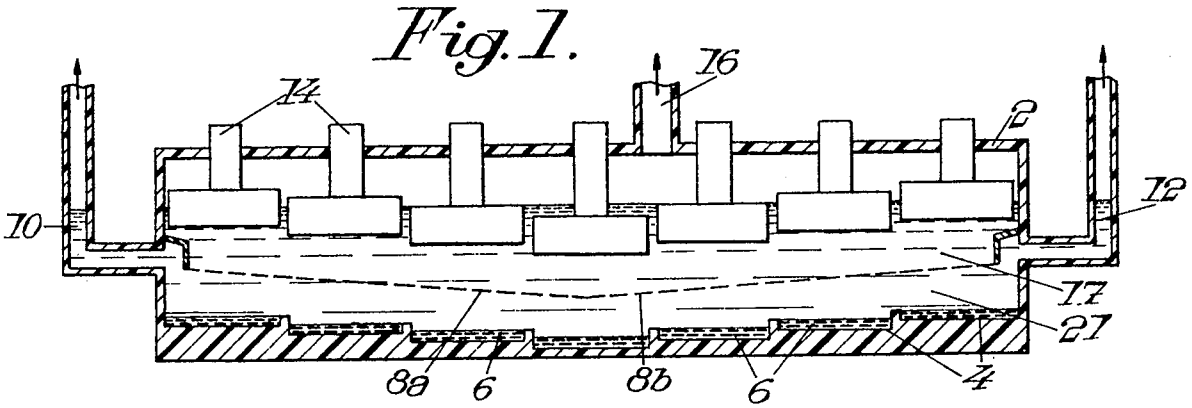
FIG. 1 is a view of an electrolyzer in cross-section along line I—I of FIG. 2, the elements necessary for understanding of the invention being illustrated only.
Figure 2:
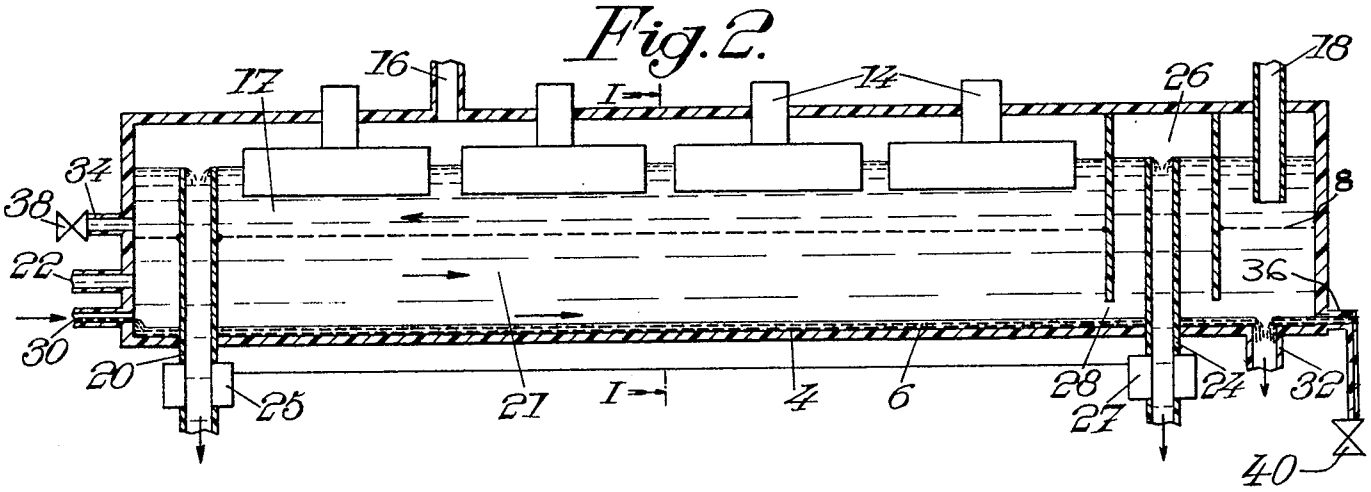
FIG. 2 is a longitudinal cross-section of the electrolyzer.

Referring to FIGS. 1 and 2, there is shown an electrolyzer having a housing 2 made of a material which is resistant to corrosion by the electrolytes and by the compounds formed at the electrode. The lower part of the electrolyzer is provided with a plurality of channels 4 connected to the negative terminal of a D.C. source (not shown). A shallow layer of mercury 6 forming the cathode of the electrolyser flows along the channels 4. The channels 4 are not located at the same horizontal level, but are staggered in the direction transverse to the direction of flow of the mercury. The midlines of the channels are situated in a plane which is substantially parallel to an inclined diaphragm 8. In the illustrated embodiment, diaphragm 8 has two parts of symmetric slope 8*a* and 8*b*. The slope is sufficient for gases produced during electrolysis not to be trapped underneath the diaphragm. The gases flow to the upper part of the cathode compartment whence they are discharged through pipes 10 and 12.

A plurality of anodes 14 are located above the diaphragm 8. The distance between the cathode and the anodes is approximately constant throughout the electrolyzer. The anodes are connected to the positive terminal of the D.C. source (not shown). The gas produced in the anode compartment is collected and evacuated by a pipe 16.

Referring to FIG. 2, pipe means are provided for flowing liquid electrolytes into and from the two compartments. The anolyte enters the anode compartment 17 through an inlet 18 situated at one end of the electrolyzer and leaves the compartment via one or more overflow pipes 20 located at the other end. The position of the overlfow may be adjustable for controlling the level of the body of anolyte.

Catholyte is introduced into cathode compartment 21 through one or more pipes 22. In the illustrated embodiment, the catholyte flows in countercurrent to the anolyte and in the same direction as the mercury and leaves the electrolyzer by one or more overflow pipes 24 located in a chamber 26 which is so designed that only catholyte can enter it.

For that purpose, chamber 26 is limited by two transversal partitions whose lower part is formed with apertures 28 through which the chamber 26 communicates with the cathode compartment. The level of the overflow pipe or pipes 24 can be adjusted to balance the pressures in compartments 17 and 21. The level may be adjusted manually. However, in the illustrated embodiment, a flowmeter 25 of conventional design is located at the anolyte outlet and provides an output signal to a servocontrol system which raises or lowers the overflow pipe 24 according to the rate of outflow of anolyte. The servocontrol system may be conventional and include a comparator and a motor for moving up and down the overflow pipe or pipes 24. Assuming that the anolyte inflow rate is constant, any increase in the anolyte outflow indicates migration of catholyte into the anolyte due to insufficient anolyte pressure. Responsive to any input signal indicating a flow rate in excess of a set value of the comparator, the motor of the control system lifts the overflow pipe or pipes 24. The control system may include conventional differentiating and integrating circuits for stability.

Mercury enters the electrolyzer at 30, flows along the electrolyzer in the same direction as the catholyte and leaves through an outlet 32 which may also be provided with an overflow pipe.

Last, pipes 34 and 36 provided with cut off valves 38 and 40 may be provided for complete emptying of the electrolyzer when required.

In the illustrated embodiment, the anolyte and catholyte flow in countercurrent but the apparatus could also be designed so that they flow in the same direction. Anyway, mercury flows in the same direction as the catholyte.

Figure 3:
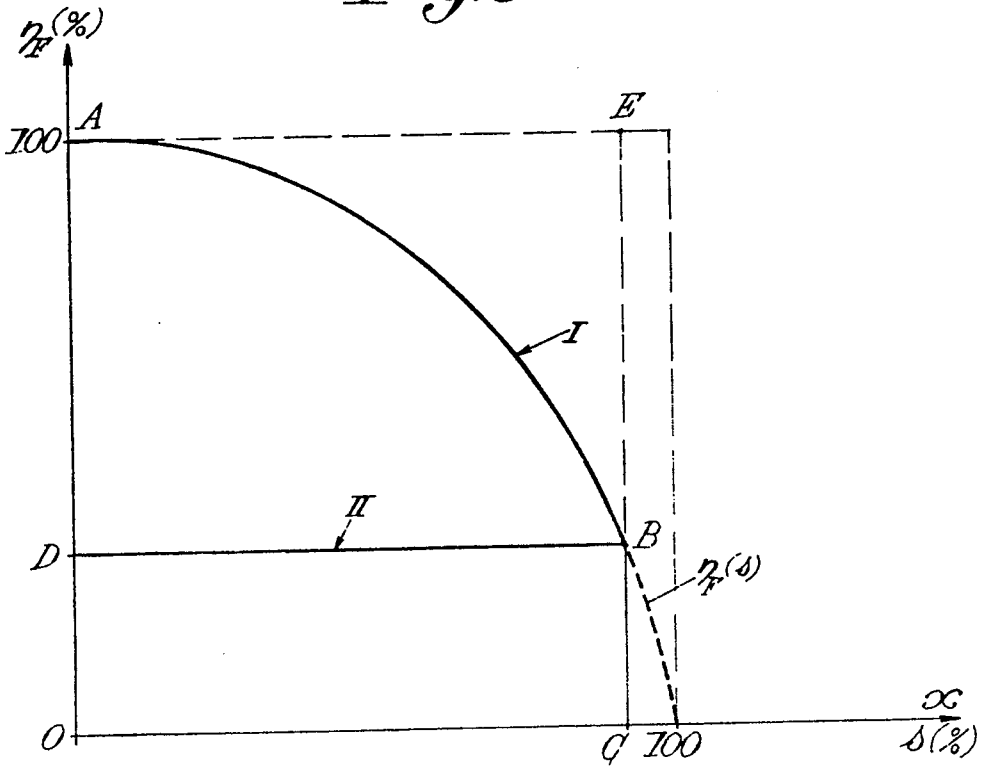
FIG. 3 is a diagram which shows the variation of the Faraday yield $\mu_F$ along the electrolyzer when their is a "lump" flow (curve I) and complete remixing (curve II).

The advantage of using an electrolyzer in which mixing of the catholyte fractions is minimized appears on FIG. 3 which corresponds to an electrolytic reduction. On FIG. 3:

curve I indicates the Faraday yield $\mu_F$ as plotted against the percentage $s$ of actually reduced product with respect to the initial percentage (from 0 to 100%); the part of the curve in full line corresponds to the variation of yield $\mu_F$ as a function of the distance $x$ from the input, assuming that the percentage of product which has been reduced prior to outflow is 92%;

curve II is the yield $\mu_F(x)$ assuming that the mixing is complete, that is the reduced product concentration is equal to the concentration at the outlet of the electrolyzer throughout the electrolyzer.

In the first case, the overall Faraday yield R is:

$$R = \text{area ABCO/area AECO}$$

In the second case, $$R = \text{area BDCO/area AECO}$$

The use of an electrolyzer whose length is important with respect to the width and in which the catholyte and mercury flow at speeds which are not too different makes it possible to operate close to curve I, with a relatively high yield.

As an example, data will now be given which correspond to electrolyzers used for the preparation of uranium III chloride from uranium IV chloride with a yield of 85%. Such an electrolyzer may be used in an apparatus of the type disclosed in French patent specification No. 74 29111, published under No. 2,282,928, to which reference may be made.

The production of $UCl_3$ requires precautions, in particular the use of non-metallic materials for the manufacture of the enclosure and pipes: the presence of metals of groups III to VIII of the Periodic Classification causes the $UCl_3$ solutions obtained to be unstable.

The horizontal electrolyzer used, which is 11 m in length and 1 m in width, has anode and cathode surface areas each amounting to about $10m^2$. The two compartments are separated by a glass frit diaphragm 5 mm in thickness. The distance between the anodes and the diaphragm is 8 mm and the distance between the cathode and the diaphragm is also 8 mm.

The cathode compartment is supplied with an aqueous 1.3 M solution of $UCl_4$ in 1N hydrochloric acid at a rate of 550 liters per hour. The anode compartment is supplied with a 6N hydrochloric acid solution at the rate of 2500 liters per hour.

The following current densities and voltages are maintained during the operation:

Current density at the level of the mercury = 0.2 $A/cm^2$

Current density at the level of the diaphragm = 0.2 $A/cm^2$

Current density at the level of the anode = 0.21 $A/cm^2$

Cathode: electrochemical potential + excess voltage = 1 V

Voltage drop in the catholyte = 0.82 V

Voltage drop in the diaphragm = 2.12 V

Voltage drop in the anolyte = 0.4 V

Anode: electrochemical potential + excess voltage = 1.46 V

The total voltage is therefore 5.8 volts.

In another embodiment, also for preparation of $UCl_3$, the enclosure is 30 m long and 2 m wide. Three channels, respectively 27 cm, 50 cm and 27 cm wide, each having a layer of mercury 8 mm deep are provided. The other data are similar to those given above.

We claim:

1. A horizontal mercury cathode electrolyzer comprising:

a housing, diaphragm means separating a lower cathode compartment and an upper anode compartment in said housing, a plurality of parallel channels located in said cathode compartment and inclined at a slight longitudinal angle to the horizontal, said channels being vertically staggered with respect to each other, means for delivering mercury to the upper end of each of said channels and for collecting and evacuating said mercury at the lower end of each said channel, and anode means in said anode compartment, said diaphragm means being approximately parallel to a plane passing through the longitudinal midlines of said channels and to said anode means.

2. Electrolyzer according to claim 1, wherein the slope of said plane in the direction transverse to said channels is substantially higher than the longitudinal slope of each said channels.

3. Electrolyzer according to claim 1, wherein said diaphragm is planar.

4. Electrolyzer according to claim 1, wherein said diaphragm is of dihedral shape.

5. Electrolyzer according to claim 1, wherein each of said compartments is provided with means for introducing a liquid electrolyte and with overflow means for evacuating said electrolyte.

6. Electrolyzer according to claim 5, wherein one of said overflow means is vertically adjustable.

7. Electrolyzer according to claim 6, wherein said diaphragm is porous.

8. Electrolyzer according to claim 6, having control means for automatically adjusting the level of said overflow means for pressure balance across the diaphragm to be achieved.

9. Electrolyzer according to claim 1, having means for circulating catholyte along said cathode compartment in the same direction as the mercury.

10. Electrolyzer according to claim 1, wherein the ratio between the length and the width of the casing is higher than 10.

11. Electrolyzer according to claim 1, wherein the slope of the channels is about 1.5%.

12. Electrolyzer according to claim 1, wherein the slope of said plane in the direction transverse to said channels is higher than 2%.

13. In an electrolyzer for chemically reducing ions in solution, a substantially horizontal housing, diaphragm means separating a lower cathode compartment and an upper anode compartment in said housing and having a first slope with respect to horizontal in a first longitudinal direction of said housing and a second higher slope in a second transverse direction of said housing, a plurality of parallel channels located in said cathode compartment in said longitudinal direction and each having said first slope, said channels being vertically staggered with respect to each other for their longitudinal midlines to be in a plane approximately parallel to the diaphragm means, means for delivering mercury to the upper end of each of said channels and collecting and evacuating mercury at the lower end of each of said channels, anode means located in said anode compartment substantially parallel to said diaphragm means, means for circulating a solution of the ions to be reduced in said longitudinal direction throughout said cathode compartment in the same direction as said mercury, and means for circulating a liquid anolyte longitudinally in said anode compartment.

14. Electrolyzer according to claim 13, wherein said liquid anolyte is circulated in countercurrent with said solution.

15. Electrolyzer according to claim 13, wherein said means for circulating the solution and the liquid anolyte are provided which balance the pressures across the diaphragm.

* * * * *

UNITED STATES PATENT AND TRADEMARK OFFICE

CERTIFICATE OF CORRECTION

PATENT NO. : 4,101,407
DATED : July 18, 1978
INVENTOR(S) : Pierre Hilaire et al.

It is certified that error appears in the above—identified patent and that said Letters Patent is hereby corrected as shown below:

Column 2, line 14, "1% to 1.5%" should read

-- 1°/oo to 1.5°/oo --.

Column 6, line 25, "1.5%" should read -- 1.5°/oo --.

Signed and Sealed this

*Twenty-eighth* Day of *October 1980*

[SEAL]

*Attest:*

SIDNEY A. DIAMOND

*Attesting Officer*

*Commissioner of Patents and Trademarks*